United States Patent [19]

Gwinner et al.

[11] Patent Number: 4,561,388

[45] Date of Patent: Dec. 31, 1985

[54] CYLINDER BLOCK FOR AN AIR-COMPRESSING INTERNAL COMBUSTION ENGINE

[75] Inventors: Dietrich Gwinner, Winnenden; Roland Merkle, Stuttgart; Friedrich Noltemeyer, Wailblingen-Hohenacker, all of Fed. Rep. of Germany

[73] Assignee: Daimler-Benz Aktiengesellschaft, Stuttgart, Fed. Rep. of Germany

[21] Appl. No.: 968,177

[22] Filed: Dec. 11, 1978

[30] Foreign Application Priority Data

Dec. 16, 1977 [DE] Fed. Rep. of Germany ..... 2756120

[51] Int. Cl.[4] ..... F02F 1/14; F02B 75/18

[52] U.S. Cl. ..... 123/41.74; 123/41.79

[58] Field of Search ..... 123/41.74, 41.79, 41.81, 123/193 C, 41.72, 41.83, 41.84

[56] References Cited

U.S. PATENT DOCUMENTS

| | | | |
|---|---|---|---|
| 2,162,082 | 6/1939 | Hazen | 123/41.79 X |
| 3,315,651 | 4/1967 | Dangauthier | 123/41.74 X |
| 3,385,273 | 5/1968 | Baster | 123/41.74 |
| 3,568,573 | 3/1971 | Bailey et al. | 123/41.84 X |
| 3,942,487 | 3/1976 | Zink | 123/41.74 X |

*Primary Examiner*—Charles E. Phillips

*Attorney, Agent, or Firm*—Craig & Burns

[57] ABSTRACT

A cylinder block for an internal combustion engine which includes dry liners each having a flange, and in which cooling slots are provided between two cylinders that start from the separating plane facing the cylinder head and are in communication with the cooling water circulation; the wall thickness of the cylinder block between two cylinders is thereby so dimensioned that the circumferential surfaces of the flanges at the liners are either tangential with a cooling slot; or with larger flanges in the radial direction, the flanges abut at one another above the cooling slot.

10 Claims, 4 Drawing Figures

CYLINDER BLOCK FOR AN AIR-COMPRESSING INTERNAL COMBUSTION ENGINE

The present invention relates to a cylinder block for an internal combustion engine, especially for an air-compressing internal combustion engine, which includes dry liners provided with a flange and a milled-in cooling slot between two cylinders starting from the separating plane to the cylinder head and in communication with the cooling water circulation is provided.

In internal combustion engines the aim is to keep the cylinder spacing in a cylinder block of the aforementioned type as small as possible in the interests of a short structural length and of a low weight. This aim is opposed by the fact that the wall thicknesses of the liners cannot be reduced at will because the cooling slot must have a minimum width in order to carry off a sufficient amount of heat by means of the cooling water and the flanges at the liners must be at least so large in the radial direction that the liners are securely seated in the axial direction within the cylinder block.

The present invention is concerned with the task of how the cylinder spacing can be still further reduced notwithstanding the aforementioned difficulties.

The underlying problems are solved according to the present invention in that the wall thickness of the cylinder block between two cylinders is dimensioned in such a manner that the circumferential surfaces of the flanges at the liners either are tangential to the cooling slot or; with larger flanges in the radial direction, the flanges abut at one another above the cooling slot.

It is possible by the present invention to reduce the wall thickness of the cylinder block between two cylinders up to nearly 30% while the dimensions for the liners, flanges at the liners and the cooling slot remain unchanged as compared to a cylinder block made heretofore in large series. Accordingly the distance between two cylinders and the structural length of the internal combustion engine can be correspondingly reduced.

The flanges of the liners can be made quite large so that a setting of the flanges is eliminated and a snapping-in of the liners can be reduced. Additionally, narrow manufacturing tolerances can be avoided.

In an advantageous construction according to the present invention, the cylinder block may be provided with recesses between the outer surfaces of the flanges and the cooling slot, whose depth corresponds to the height of the flanges at the liners and whose length in the direction of the cooling slot is smaller than the length of the cooling slot. Without these measures, acutely converging triangularly shaped wall parts would remain between two cylinders—as viewed in plan view on the cylinder block—which under certain circumstances would offer difficulties when pressing-in the liners into the cylinder block.

Accordingly, it is an object of the present invention to provide a cylinder block for internal combustion engines, especially for air-compressing internal combustion engines, which avoids by simple means the aforementioned shortcomings and drawbacks encountered in the prior art.

Another object of the present invention resides in a cylinder block for internal combustion engines, which permits a further reduction of the mutual spacing between cylinders without adversely affecting the rigidity or cooling of the engine.

A further object of the present invention resides in a cylinder block, in which the wall thickness of the cylinder block between two cylinders may be significantly reduced without any changes in the dimensions for the liners, the flanges at the liners, and the cooling slot as compared to previously mass-produced engines.

Still another object of the present invention resides in a cylinder block which improves the assembly, especially of the liners into the cylinders, yet avoids the need for narrow manufacturing tolerances.

These and other objects, features and advantages of the present invention will become more apparent from the following description when taken in connection with the accompanying drawing which shows, for purposes of illustration only, two embodiments in accordance with the present invention, and wherein.

Figure 1:
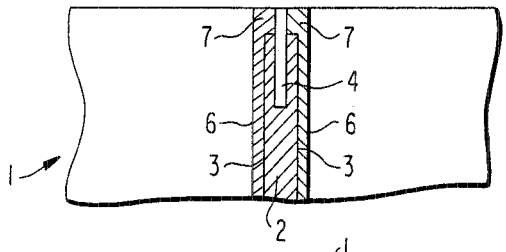
FIG. 1 is a partial longitudinal cross-sectional view through two adjacent cylinders of a cylinder block in accordance with the present invention with relatively small flanges at the liners in the radial direction, taken along line I—I of FIG. 2.
Figure 2:
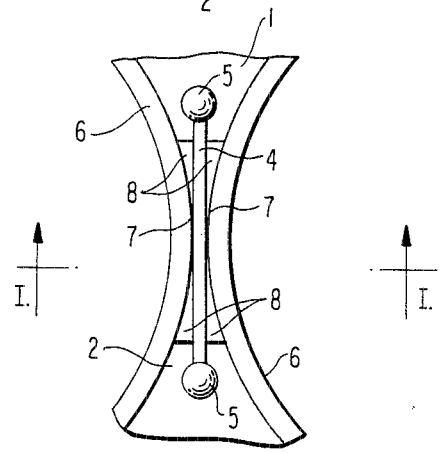
FIG. 2 is a partial plan view on the cylinder according to FIG. 1.
Figure 3:
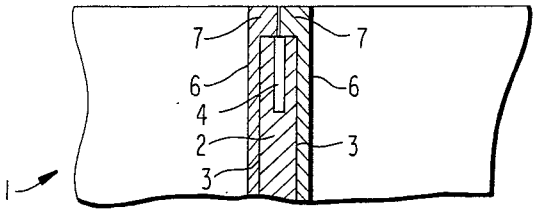
Figure 4:
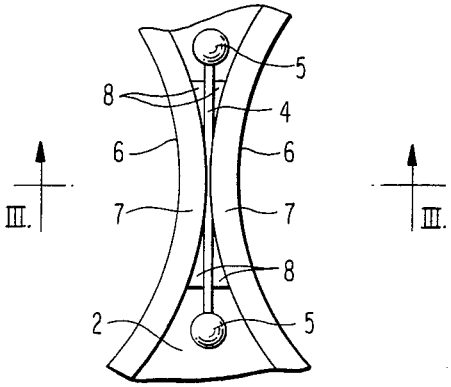

FIG. 3 is a partial longitudinal cross-sectional view, similar to FIG. 1, through two adjacent cylinders of a cylinder block in accordance with the present invention with flanges at the liners that are larger in the radial direction, and taken along line III—III of FIG. 4; and FIG. 4 is a partial plan view on the cylinder according to FIG. 3, Referring now to the drawing wherein like reference numerals are used throughout the various views to designate like parts, according to FIGS. 1 and 2, a cylinder block generally designated by reference numeral 1 for an air-compressing internal combustion engine (not shown) is provided in the wall 2 between two adjacent cylinders 3 with a cooling slot 4 which starts from the separating plane to the cylinder head and which is limited on both sides by bores 5. Liners 6 with flanges 7 are pressed into the cylinders 3. In order to keep the thickness of the wall 2 as small as possible and thereby reduce the overall length of the cylinder block and of the internal combustion engine, the liners 6 are moved so close to the cooling slot 4 that the circumferential surfaces of the flanges 7 are tangential to the cooling slot 4.

As can be seen more clearly from FIG. 2, the wall parts of the wall 2 which are disposed at the height of the flanges 7 are removed between the flanges and the cooling slot 4 so that triangularly shaped recesses 8 result, whose depth corresponds to the height of the flanges and whose overall length in the direction of the cooling slot is smaller than the length of the cooling slot.

The dimensions of the liners 6, of the flanges 7 and of the cooling slot 4 correspond to the heretofore customary and proved dimensions.

In the embodiment according to FIGS. 3 and 4, in which similar reference numerals are used as in FIGS. 1 and 2, the sole difference which exists compared to the first embodiment, is that the circumferential walls of the flanges 7 are in contact with each other above the cooling slot 4. The flanges are therefore larger in the radial direction than the flanges according to FIGS. 1 and 2.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A cylinder block for an internal combustion engine, the cylinder block comprising a plurality of cylinders, dry liner means disposed in each of the cylinders, each of the dry liner means have a flange, and cooling slot means disposed in the cylinder block between two adjacent cylinders, the cooling slot means start from a separating plane to a cylinder head and are in communication with a cooling water circulation means of the engine, characterized in that a wall thickness of the cylinder block between the adjacent cylinders is dimensioned such that circumferential outer surfaces of the flanges of the dry liner means disposed in the adjacent cylinders extend in a direction at least substantially tangentially to the the cooling slot means.

2. A cylinder block according to claim 1, characterized in that the circumferential surfaces of the flanges abut against one another above the cooling slot means.

3. A cylinder block according to claims 1 or 2, characterized in that recesses are provided in the cylinder block between the outer surfaces of the flanges and the cooling slot means, the depth of said recesses corresponds essentially to the height of the flanges and the overall length of said recesses in the direction of the cooling slot means is smaller than the length of the cooling slot means.

4. A cylinder block according to claim 3, characterized in that the cooling slot means is milled into the cylinder block.

5. A cylinder block according to claim 3, characterized in that the flanges of the dry liner means rest on exposed surfaces of the recesses in the cylinder block.

6. A cylinder block according to claim 5, wherein the flange has a single diameter.

7. A cylinder block according to claim 1, characterized in that the internal combustion engine is an air-compressing internal combustion engine.

8. A cylinder block for an internal combustion engine, the cylinder block comprising a plurality of cylinders separated by cylinder walls, a cooling slot arranged in the cylinder walls at a position equidistant between two adjacent cylinders to form a cylinder wall of a reduced thickness, means for connecting the cooling slot to a cooling water circulation means of the engine, and a dry liner disposed in each of the cylinders and having a flange of a single diameter, and triangularly-shaped recesses provided in the cylinder wall between outer circumferential surfaces of the flanges and the cooling slot, the triangular shaped recesses follow a curvature of said flanges for a distance less than an overall length of the cooling slot.

9. A cylinder block according to claim 8, wherein each of the triangular recesses has a depth corresponding to a height of the flanges.

10. A cylinder block according to one of claims 8 or 9, wherein the means for connecting the cooling slot to a cooling water circulation means include a bore means disposed along respective lateral sides of the cooling slot.

* * * * *